US010273863B2

(12) United States Patent
Bruestle et al.

(10) Patent No.: US 10,273,863 B2
(45) Date of Patent: Apr. 30, 2019

(54) FAN FOR AN AIR-GUIDING SYSTEM OF AN OUTBOARD MOTOR

(71) Applicant: Neander Motors AG, Kiel (DE)

(72) Inventors: Claus Bruestle, Nordheim (DE); Richard Davis, Mequon, WI (US)

(73) Assignee: Neander Motors AG, Kiel (DE)

( * ) Notice: Subject to any disclaimer, the term of this patent is extended or adjusted under 35 U.S.C. 154(b) by 0 days.

(21) Appl. No.: 15/491,160

(22) Filed: Apr. 19, 2017

(65) Prior Publication Data

US 2017/0306829 A1 Oct. 26, 2017

(30) Foreign Application Priority Data

Apr. 20, 2016 (DE) ..... 10 2016 004 776

(51) Int. Cl.

| | |
|---|---|
| ***B63H 20/00*** | (2006.01) |
| ***B63H 20/32*** | (2006.01) |
| ***B63H 21/14*** | (2006.01) |
| ***F01P 1/02*** | (2006.01) |
| ***F01P 5/06*** | (2006.01) |
| ***F02B 61/04*** | (2006.01) |

(Continued)

(52) U.S. Cl.

CPC ..... *F01P 1/02* (2013.01); *B63H 20/001* (2013.01); *B63H 21/14* (2013.01); *F01P 5/06* (2013.01); *F02B 61/045* (2013.01); *F02B 75/007* (2013.01); *F02B 75/065* (2013.01); *F04D 19/002* (2013.01); *F04D 29/263* (2013.01); *F01P 2050/12* (2013.01)

(58) Field of Classification Search

CPC .. F01P 1/02; F01P 5/06; F01P 2050/12; F04D 29/263; F04D 19/002; F02B 75/065; F02B 75/007; F02B 61/045; B63H 20/001; B63H 21/14

See application file for complete search history.

(56) References Cited

U.S. PATENT DOCUMENTS 5,445,547 A * 8/1995 Furukawa ..... F02B 61/045 440/77

6,302,749 B1 10/2001 Tawa et al.

(Continued)

FOREIGN PATENT DOCUMENTS

DE 102 05 109 B4 3/2015
EP 2 696 054 A1 2/2014

(Continued)

*Primary Examiner* — Anthony D Wiest

(74) *Attorney, Agent, or Firm* — Crowell & Moring LLP

(57) ABSTRACT

A fan is suitable for an air-guiding system of an outboard motor including an internal combustion engine and a covering hood bounding an engine interior space. The engine drives the fan, which is connected to an upright shaft journal projecting beyond an upper side of a housing of the engine. The covering hood has air flow openings, and the fan influences the air flows in the covering hood interior space. A flywheel, fixedly attached to the upright shaft journal, carries a fan wheel of the fan. The fan wheel is set in place from above, and the flywheel carries the fan wheel for conjoint rotation. Airflows enter the interior space via an inlet opening and a first conducting device, and the airflows, under the action of the fan, act upon at least parts of surfaces of the internal combustion engine and the auxiliary units to cool the internal combustion engine.

19 Claims, 5 Drawing Sheets

(51) Int. Cl.

| | |
|---|---|
| ***F04D 19/00*** | (2006.01) |
| ***F02B 75/00*** | (2006.01) |
| ***F02B 75/06*** | (2006.01) |
| ***F04D 29/26*** | (2006.01) |

(56) References Cited

U.S. PATENT DOCUMENTS

| | | | | |
|---|---|---|---|---|
| 8,707,915 | B2 * | 4/2014 | Inaba | B63H 20/32<br>123/198 E |
| 2002/0111088 | A1 | 8/2002 | Tsubouchi et al. | |
| 2014/0041385 | A1 * | 2/2014 | Wittwer | F02B 61/045<br>60/605.2 |
| 2016/0032819 | A1 | 2/2016 | Bruestle | |

FOREIGN PATENT DOCUMENTS

| | | | | |
|---|---|---|---|---|
| EP | 2 980 374 | A1 | | 2/2016 |
| JP | 10007087 | A | * | 1/1998 |

* cited by examiner

FAN FOR AN AIR-GUIDING SYSTEM OF AN OUTBOARD MOTOR

CROSS REFERENCE TO RELATED APPLICATIONS

This application claims priority under 35 U.S.C. § 119 from German Patent Application No. 10 2016 004 776.3, filed Apr. 20, 2016, the entire disclosure of which is herein expressly incorporated by reference.

BACKGROUND AND SUMMARY OF THE INVENTION

The present invention relates to a fan for an air-guiding system of an outboard motor, which comprises an internal combustion engine and a covering hood bounding an interior space for the internal combustion engine.

An internal combustion engine known from U.S. Pat. No. 6,302,749 B1 operates as an outboard motor for driving a watercraft. The internal combustion engine is surrounded by a covering hood which bounds an interior space. For ventilation and venting of the interior space, inlet and outlet devices for airflows moving in the interior space of the covering hood and serving to act upon housing surfaces of the internal combustion engine are provided on the covering hood, which substantially covers the internal combustion engine. The internal combustion engine comprises an upright crankshaft, which interacts with a plurality of pistons and drives balance shafts at an upper end region by means of an endless drive. An alternator with an upright axis of rotation projecting beyond an upper side of a housing of the internal combustion engine is provided with a fan, which ventilates and vents the interior space of a hood-like endless drive covering.

German document DE 102 05 109 B4 concerns an outboard motor provided with a vertically oriented crankshaft and a plurality of auxiliary units attached to an outer side of an engine housing of the outboard motor. A covering hood covers the outboard motor and the auxiliary units. Air inlet slots, which interact with an adjacent air-conducting device, are provided on a rear side of the covering hood. The air-conducting device ensures that fresh air is conducted into an upper region and a lower region of the interior space of the covering hood or to the engine housing and to the auxiliary units.

European document EP 2 696 054 A1 relates to an outboard motor, the internal combustion engine of which is clad by a covering hood bounding an interior space. The internal combustion engine has a housing which accommodates two parallel and upright crankshafts of a crankshaft system.

It is the object of the invention to design a fan for an air-guiding system of an outboard motor with an internal combustion engine and a covering hood bounding an interior space, with the fan arranged and effective in the interior space in such a manner that airflows moving in the interior space contribute in a specific manner to cooling of the internal combustion engine. However, it is also to be ensured that precautions suitable for protecting people are taken with regard to the fan and flywheels of a crankshaft system of the internal combustion engine.

The object mentioned is achieved by the features claimed. Further features of the invention are set out in dependent claims.

Advantages primarily achieved with the invention are that the fan influences airflows in the interior space of the covering hood in such a manner that the airflows first flow, via the inlet opening and the first conducting device, into the interior space of the covering hood. These airflows are guided in a specific manner past surfaces of the internal combustion engine and the auxiliary units thereof, and the airflows bring about an operation-ensuring cooling effect of the surfaces within the covering hood. The fan is placed onto the flywheel of the crankshaft of the internal combustion engine, and the fan is carried and taken along by said flywheel, i.e. the functional region of the flywheel is extended, and the fan and the flywheel can be produced as an assembly. The cooling effect is assisted by the fan having an impeller system with a mixed flow, a radial flow, or the like, and by the fan conducting heated airflows via a conducting device and an outlet opening in the covering hood in a defined manner to the outside or into the atmosphere. The design is supported in that, in a center longitudinal axis of the crankshaft comprising the shaft journals, the flywheel has a radial carrying region on which a corresponding support region of the fan wheel rests, so that at least one screw connecting the flywheel and the fan wheel to form a constructional unit is effective. An exemplary design here is that the fan wheel is formed by a cylindrical body and has two ringed carriers, which run at an axial distance with respect to each other and are connected to each other with the interconnection of fan blades. An expedient solution is that the fan wheel is provided with a dome-like air-conducting element for heated air in the region of an axial fastening screw penetrating the carrying region and the supporting region and keeping the flywheel in position on the shaft journal.

When the covering hood is open or removed and the internal combustion engine is running, to permit people carrying out service activities on the outboard motor to act with little risk of injury, the fan wheel and the flywheel are clad with a protective hood which has a cover region with a central inlet opening and a casing region. The protective hood is designed in the manner of a housing, in which the second conducting device for the heated airflows is integrated, and the housing has a tangential portion, which is provided with an outlet device at an end region, with the outlet device connected to an outlet opening in the covering hood. Furthermore, the protective hood on its outer side has one or more stiffening ribs, which make possible the use of lightweight materials, such as composite materials, plastics, or the like.

The invention is optimized by having the outboard motor comprise an internal combustion engine with a crankshaft system having two upright crankshafts, which crankshafts project with shaft journals beyond an upper side of the housing of the internal combustion engine. Flywheels are fastened to the shaft journals, and the flywheels are arranged offset with respect to each other, as viewed in the vertical direction, and mutually overlapping. Scales are set by having the one flywheel with the fan lie above the other flywheel, as viewed in the vertical direction, and the latter flywheel is clad with a connecting protective hood, which supplements the protective hood and has a cylinder portion. By way of example, the protective hood and the connecting protective hood are produced as a fan and flywheel covering produced from a single piece or assembled from a plurality of parts. The fan and flywheel covering is provided on outer regions with fastening eyes at which the fan and flywheel covering is kept in position on the housing of the internal combustion engine with the aid of holding devices which can easily be realized. It is also technically preferably for each holding device to interact with the fan and flywheel covering with the interconnection of an elastic support element.

Finally, it is of high structural and functional importance that the airflows enter via the inlet opening in the first upright hood wall and the first connecting device adjoining the inlet opening into the interior space of the covering hood. The fan is arranged adjacent to a second upright hood wall of the covering hood, which hood wall extends at a distance from the first hood wall, as viewed in the longitudinal direction of the outboard motor, and conveys the airflows over a relatively large region of action, which runs in the longitudinal direction, past the surfaces of the internal combustion engine and the auxiliary units. The fan conveys heated airflows as exhaust air with the aid of the second conducting device into an outlet opening in the covering hood to the outer side of the covering hood or into the atmosphere.

BRIEF DESCRIPTION OF THE DRAWINGS

The drawings show an exemplary embodiment of the invention, which is explained in more detail below. Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
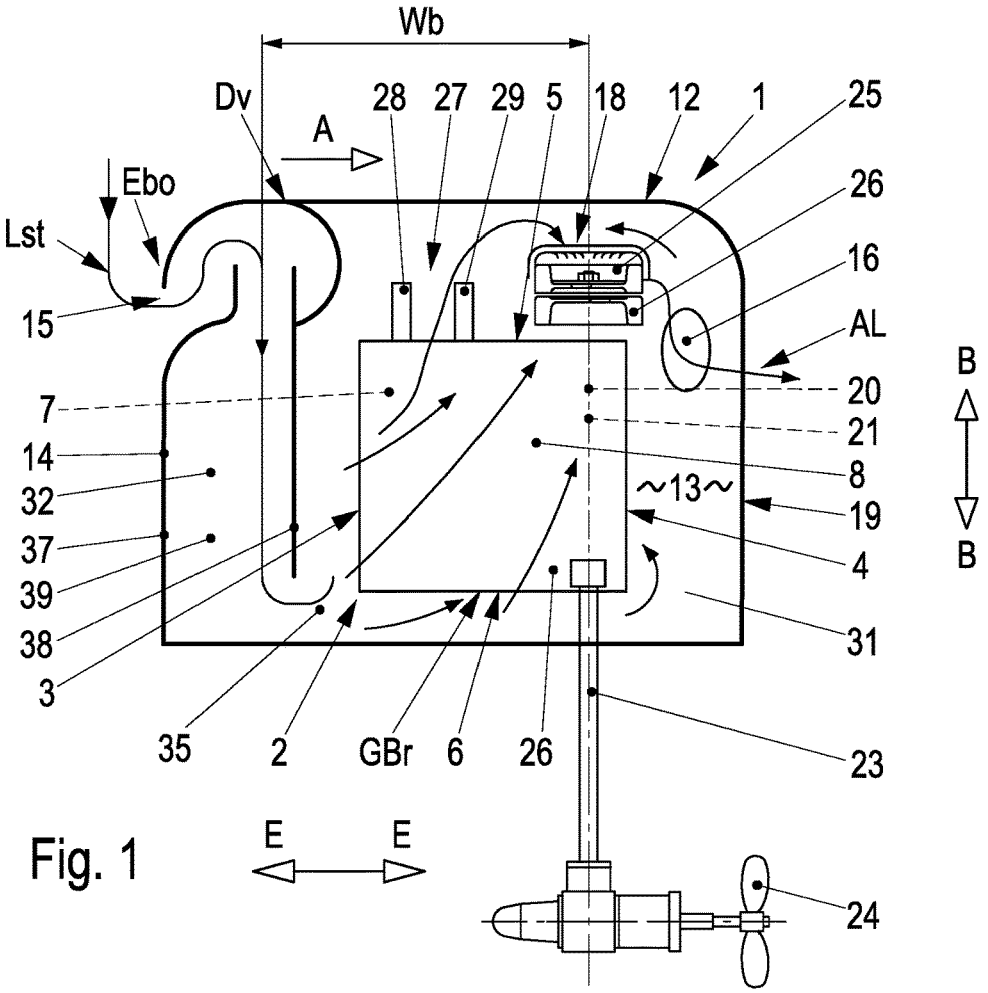
FIG. 1 is a schematic side view of an outboard motor with a covering hood, an internal combustion engine and a fan for an air-guiding system.

An outboard motor 1 serves for driving a ship (not illustrated specifically) in bodies of water. The outboard motor 1 comprises an internal combustion engine 2, which has, as viewed in the direction of travel A of the ship, a rear side 3, a front side 4 and, as seen in the vertical direction B-B, an upper side 5, and a lower side 6, on a housing GBr. Furthermore, the internal combustion engine 2 is bounded by a left longitudinal side 7 and a right longitudinal side 8. A plurality of auxiliary units, for example, 9, 10, and 11, are added to the longitudinal sides 7 and 8 (FIG. 5); the auxiliary units not explained in more detail.

Figure 2:
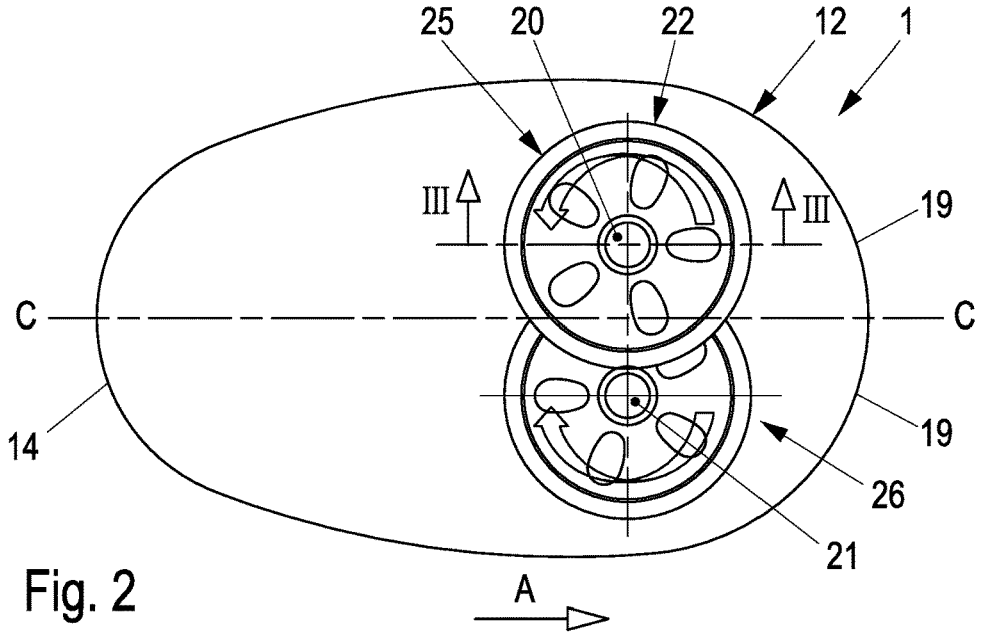
FIG. 2 is a schematic view from above of a crankshaft system of the internal combustion engine.

A covering hood 12 surrounds the internal combustion engine 2 with its auxiliary units 9, 10 and 11 or the surfaces thereof, and forms an interior space 13. An inlet opening 15 via which airflows Lst flow into the interior space 13 of the covering hood 12 is provided on an upright first (as viewed in the direction of travel A) rear hood wall 14 of the covering hood 12, which hood wall is adjacent to the rear side 3. For this purpose, the covering hood also has an outlet opening 16 (FIGS. 1 and 5) for exhaust airflows AL. The outlet opening is incorporated into an upright, left lateral hood wall 17, specifically at a defined distance from the rear hood wall 14. A fan 18 (FIGS. 1, 2, 3, and 5), which is arranged on the upper side 5 of the internal combustion engine 2 and is driven by the latter, serves to move the airflows Lst. A front (as seen in the direction of travel A) second hood wall bears the reference sign 19 (FIGS. 1 and 2).

Figure 5:
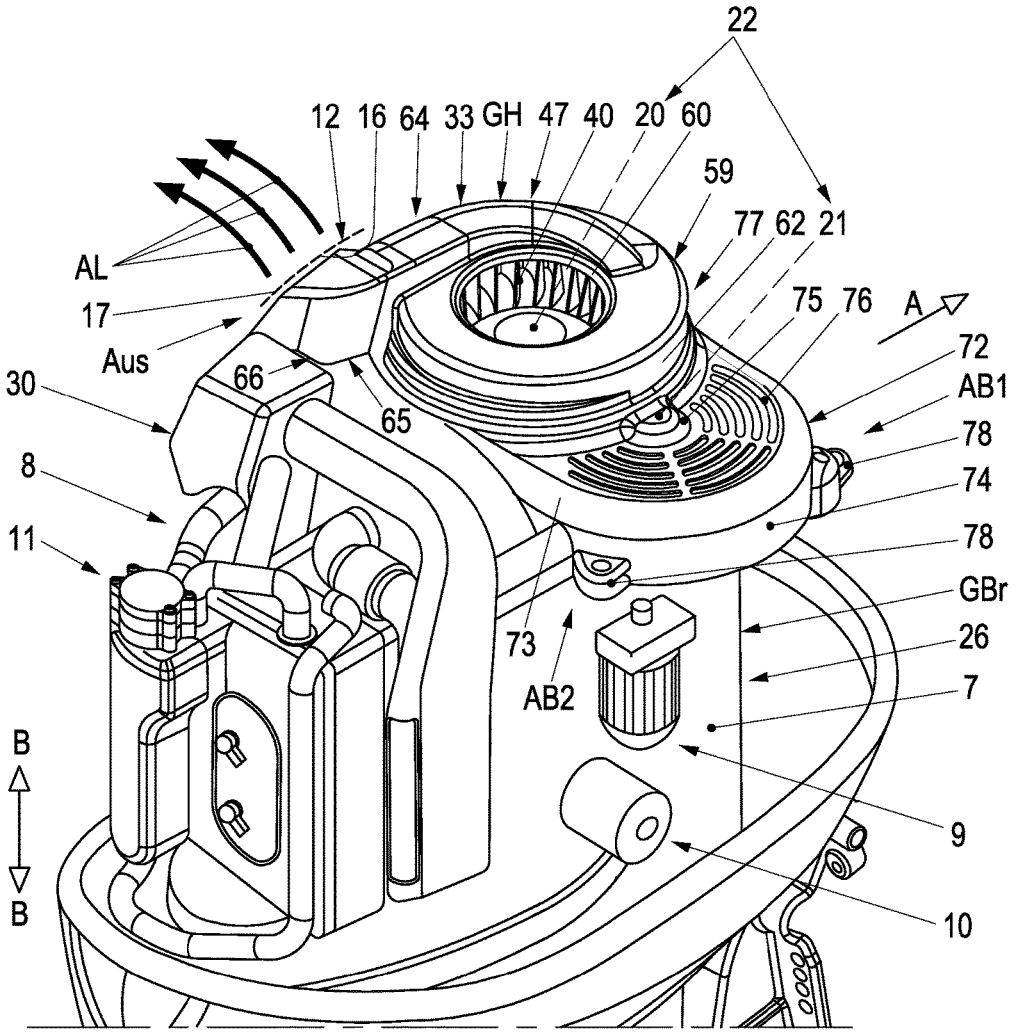
FIG. 5 is a schematic oblique view of a fan and a flywheel covering with a fan wheel.

The internal combustion engine 2 of the reciprocating piston type has at least one reciprocating piston which is operatively connected with the aid of two connecting rods to two first and second crankshafts 20 and 21, which are oriented parallel to each other and rotate in opposed directions of rotation. The first and second crankshafts 20 and 21 of a crankshaft system 22 (FIGS. 1 and 2) are present in a relatively upright manner with respect to a ship waterline (not shown) and drive a ship's propeller 24 (FIG. 1) by means of a driveshaft 23 below a waterline. The crankshafts 20 and 21 project over the upper side 5 of the internal combustion engine 1, lie next to each other transversely with respect to the direction of travel A symmetrically to a center longitudinal plane C-C (FIG. 2) of the internal combustion engine 2, and are provided with first and second flywheels 25 and 26 (FIGS. 1 and 2) at end regions. As viewed in the vertical direction B-B, the first flywheel 25 and the second flywheel 26 are fastened in a manner offset with respect to each other in the vertical direction B-B to the crankshafts 20 and 21, so that they mutually overlap in regions for space-saving reasons (FIGS. 2 and 5). The first flywheel 25 lies above the second flywheel 26, which first flywheel 25 carries a fan 18 (FIG. 1).

The internal combustion engine 1 accommodates the crankshafts 20 and 21 by means of a housing GBr, and the internal combustion engine 1 operates according to a diesel exhaust gas turbine 29 is provided for optimizing the operation of the internal combustion engine. The exhaust gas turbocharger device 27 is connected to a suction system 30 of the internal combustion engine 1, which exhaust gas turbocharger device 27 and suction system 30 (FIG. 5) are arranged on the upper side 5 of the internal combustion engine 1, specifically not far from the rear hood wall 14 of the covering hood 12. Further details of the internal combustion engine 1 are available from European publication EP 2 980 374 A1, which deals with a similar internal combustion engine.

Together with the inlet opening 15, the outlet opening 16, and the fan 18, an air-guiding system 31 (FIG. 1) is effective in the interior space 13 of the covering hood 12. The relatively cool airflows Lst entering via the inlet opening 15 of the rear hood wall 14 pass here into a first conducting device 32, which adjoins said inlet opening 15 and from where, with the support of the fan 18, the airflows Lst act upon operationally heated surfaces of the internal combustion engine 1 or auxiliary units 9, 10 and 11. Airflows Lstw (FIG. 3) heated by the surfaces of the internal combustion engine 2 or of the auxiliary units 9, 10 and 11 are conveyed by the fan 18 and a second conducting device 33 as exhaust air AL via the outlet opening 16 in the hood wall 17 of the covering 12 to an outer side Aus of the latter or into the atmosphere.

The inlet opening 15 is arranged at an upper end region Ebo adjacent to an upper top cladding Dv of the hood wall 14 (FIG. 1) and the first conducting device 32 extends upright from the inlet opening 15 in the direction of the lower side 6 of the internal combustion engine 2. Adjacent to said lower side 6, the conducting device 32 has an overflow region 35 (FIGS. 1 and 3) toward the interior space 13. The first conducting device 32 is formed by a hood wall portion 37 of the hood wall 14 and an upright inner wall 38 of the covering hood 12; hood portion 37 and inner wall 38 form a feed channel 39 (FIGS. 1 and 3).

Figure 3:
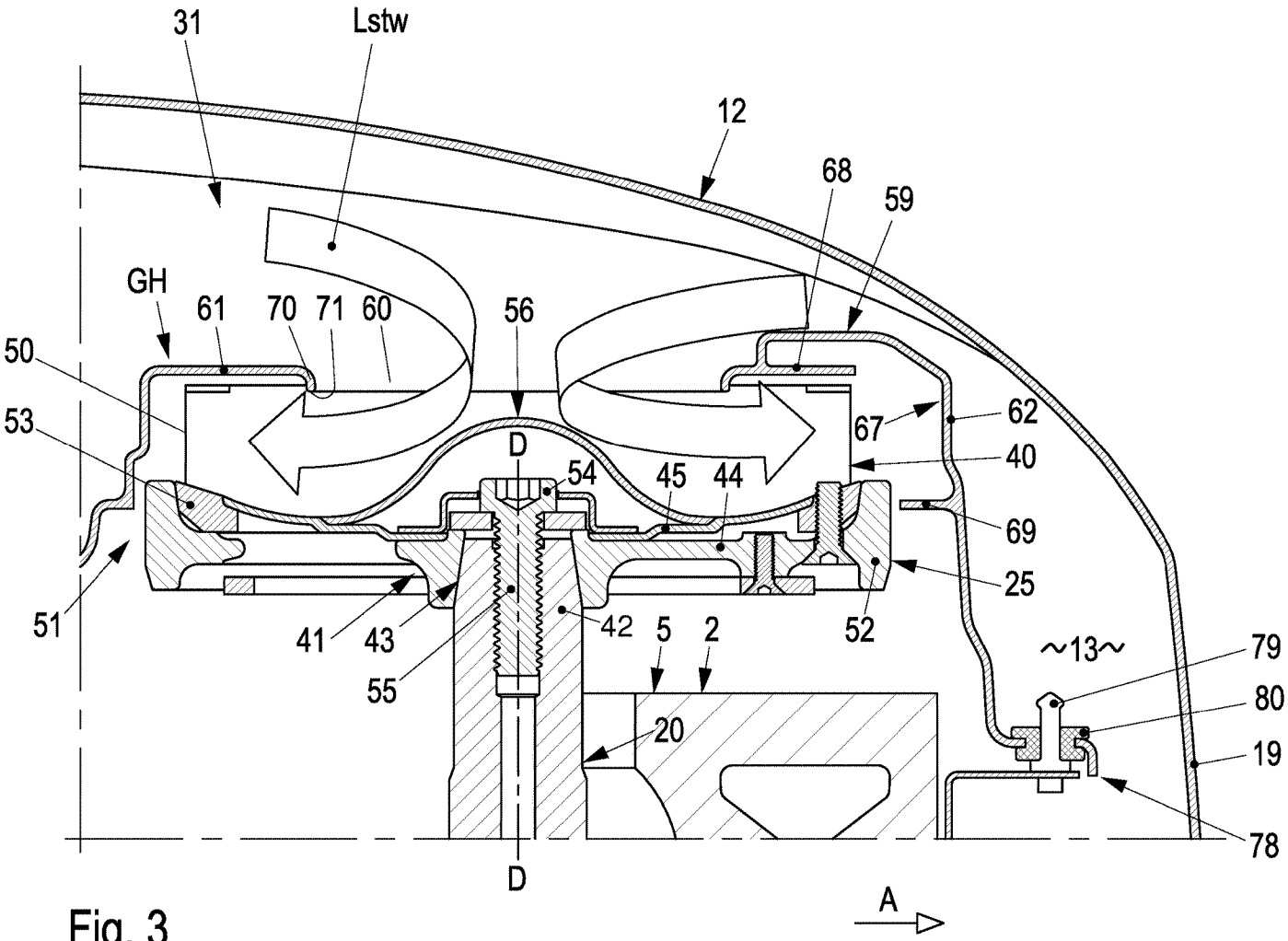
FIG. 3 is a view of a section as seen along a line III-III in FIG. 2.

The crankshaft 20 or the flywheel 25 serves for driving a fan wheel 40 of the fan 18, which crankshaft 20 and which flywheel 25 project beyond the upper side 5 of the internal combustion engine 2 (FIGS. 1 and 3). The fan wheel 40 and the flywheel 25 are structurally combined; expressed in other words, they are assembled, for example, in the manner of a module. At an upper end 41 of the crankshaft 20, a shaft journal 42 is provided which is fixedly connected with the aid of a frictionally locking connection 43—wedge connection—to the first flywheel 25. The first flywheel 25 bears the fan wheel 40, so that the latter is placed onto the flywheel 25 from above. The fan wheel 40 interacts with a fan housing GH as an impeller system with a mixed flow, radial flow or the like.

Figure 4:
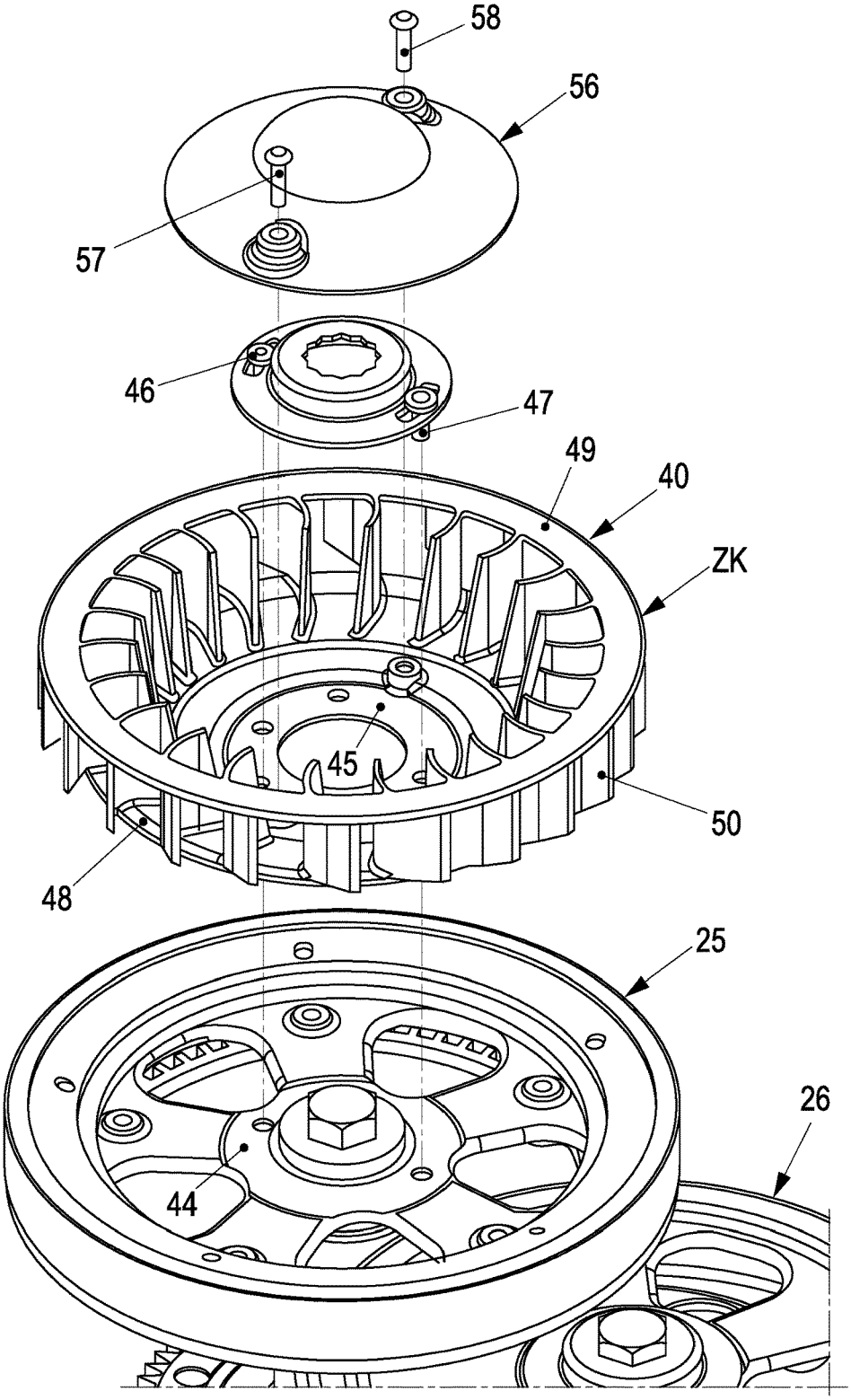
FIG. 4 is an exploded view of the flywheel and of the fan wheel.

In a center longitudinal axis D-D of the first crankshaft 20 comprising the shaft journal 42, the first flywheel 25 has a radial carrying region 44 on which a corresponding support region 45 of the fan wheel 40 directly rests. The carrying region 44 and the support region 45 are connected to each other by means of screws 46 and 47 (FIG. 4). The fan wheel 40 is formed by a cylindrical body ZK, and it has two lower and upper ring carriers 48 and 49 which run at an axial distance from each other and are combined with the intermediate connection of a multiplicity of radial fan wheel blades 50 to form a constructional unit composed of composite material, plastic or the like. An encircling boundary web 52 which projects beyond the radial carrying region 44 is attached adjacent to an outer circumference 51 of the flywheel 25. A ring 53 made of metal (FIG. 3) with a defined specific weight is provided between boundary web 52 and carrying region 44 in order to compensate for the flywheel mass which is reduced by the receiving structure on the flywheel 25 for the fan wheel 40. The fan wheel 40 has a dome-like air-conducting element 56 in the region of the axial frictionally locking connection 43 to an axial fastening screw 55 keeping the flywheel 25 in position on the crankshaft 20 and projecting with a screw head 54 beyond the carrying region 44 and the support region 45. By way of the concave air-conducting element 56 which is guided away from the screw head 54, the heated airflows Lstw are conducted into the second conducting device 33 of the fan 18. The air-conducting element 56 is fastened with the aid of screws 57 and 58 to the support region 45 of the fan wheel 40.

Figure 6:
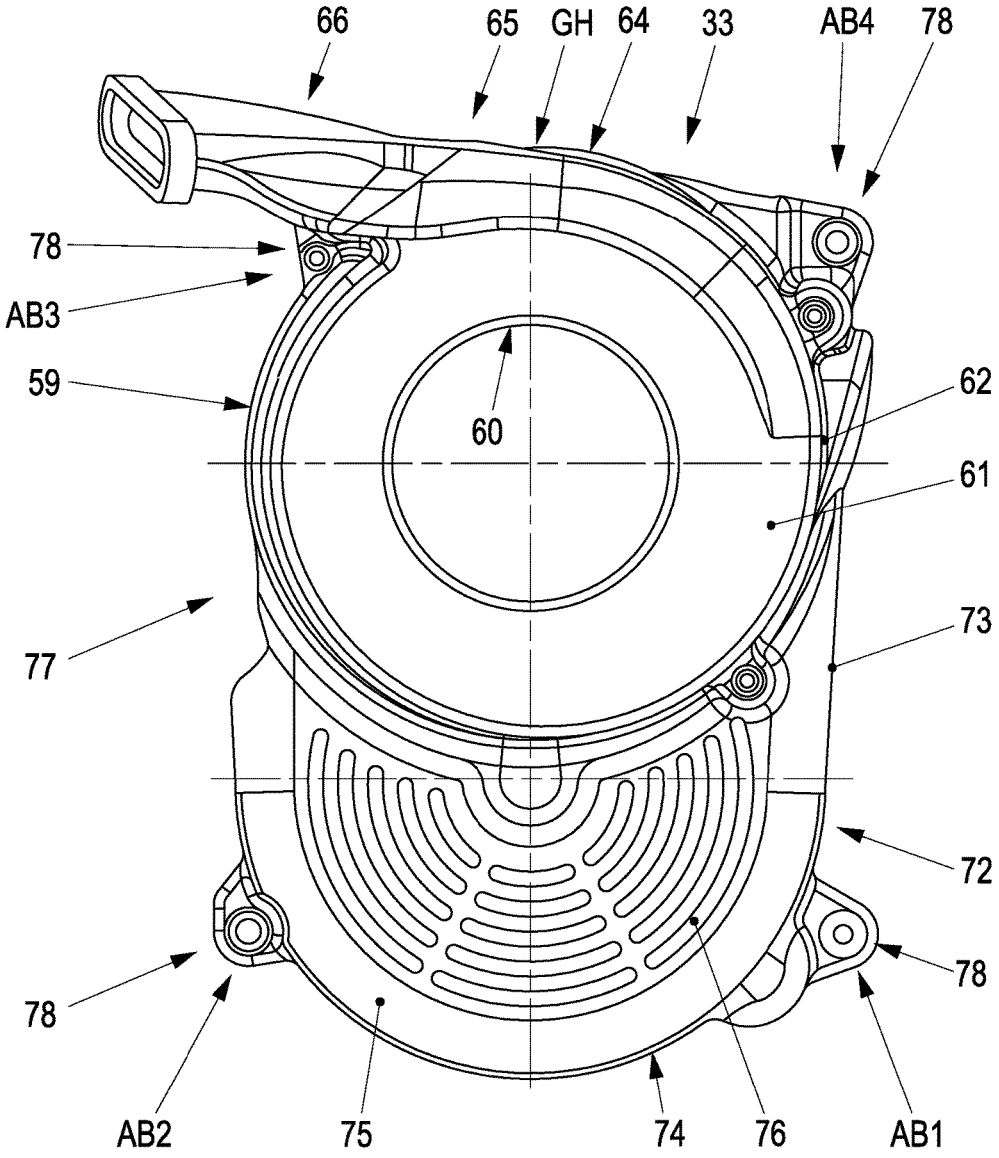
FIG. 6 is a view from above the fan and the flywheel covering.

The flywheel 25 and the fan wheel 40 are clad with a cylinder-like protective hood 59 which comprises a cover region 61 having an inflow opening 60 and a casing region 62 surrounding said cover region. The second conducting device 33 for the heated airflows Lstw is integrated into the fan housing GH of the protective hood 59. And the fan housing GH has a channel-shaped tangential portion 64 which is provided with an outlet device 66 at an end region 65 (FIGS. 5 and 6). The outlet device 66 is connected here to the outlet opening 16 in the covering hood 12. Furthermore, the protective hood 59 is provided on an inner side 67 with one or more, for example, horizontal stiffening ribs 68 and 69. The inflow opening 60 is bounded by a bent-out flange portion 70 which is oriented in the direction of the fan wheel blades 50 (FIG. 3) and is brought at one end 71 as close as possible to the fan wheel blades 50 in order at least to reduce pressure losses of the fan 18 during operation.

The one flywheel 26 which lies below the other flywheel 25 is clad with a connecting protective hood 72, which supplements the protective hood 59 and has a connecting portion 73 and a cylinder portion 74. One or more venting slot openings 76, which are in the manner of a partial circle are provided in a cover region 75 which is stepped towards the cover region 61. The protective hood 59 and the connecting protective hood 72 are produced as a fan and flywheel covering 77, which is produced from a single piece or is composed of a plurality of parts and is composed of plastic, composite material or the like. Fastening eyes 78 are integrally formed on outer regions AB 1 to 4 of the fan and flywheel covering 77, at which fastening eyes the fan and flywheel covering 77 is kept in position on the housing GBr of the internal combustion engine 2 by means of holding devices 79. Each holding device 79 interacts with the fastening eye 78 of the fan and flywheel covering 76 with the aid of an elastic support element 80.

Finally, the airflows Lst enter via the first inlet opening 15 in the first upright hood wall 14 and the adjoining first conducting device 32 into the interior space 13 of the covering hood 12, wherein the fan 18 is arranged adjacent to the second upright hood wall 19 of the covering hood 12, which hood wall extends at a distance from the first hood wall 14, as viewed in the longitudinal direction E-E of the outboard motor 1 and conveys the airflows Lst over a relatively large region of action Wb, which runs in the longitudinal direction E-E, past the surfaces of the internal combustion engine 2 and the auxiliary units 9, 10 and 11, and wherein the fan 18 conveys heated airflows Lstw as exhaust air AL with the aid of the second conducting device 33 into the outlet opening 16 in the covering hood 12 and to the outer side Aus of the covering hood 12 or into the atmosphere. The efficient distribution of the airflows Lst to the surfaces of the internal combustion engine 2 and of the auxiliary units 9, 10 and 11 is optimized by the fact that between overflow region 35 and the inflow opening 60 of the fan 18 there is a height difference by means of which the airflows Lst are distributed to said surfaces.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An outboard motor with a fan for an air-guiding system of the outboard motor comprising:

an internal combustion engine driving the fan, a covering hood bounding an interior space for the internal combustion engine, the covering hood being provided with an inlet opening and an outlet opening for airflows in the interior space and the fan influencing said airflows in the interior space of the covering hood to act upon at least parts of surfaces of the internal combustion engine and auxiliary units thereof in order to cool said internal combustion engine, a crankshaft system having two upright crankshafts that project with upright shaft journals beyond an upper side of a housing of the internal combustion engine, each of the upright shaft journals of the two upright crankshafts having a flywheel attached thereto, wherein a fan wheel of the fan is set in place from above in a receiving structure and carried along by one of said flywheels for conjoint rotation, and a ring made of metal with a defined specific weight is provided in order to compensate for a flywheel mass of said one of said flywheels that is reduced by the receiving structure on said one of the flywheels.

2. The outboard motor with the fan as claimed in claim 1, further comprising an impeller system with a mixed flow or a radial flow, the fan conducting heated airflows via a conducting device of the fan and the outlet opening in the covering hood to an outer side of the covering hood or into the atmosphere.

3. The outboard motor with the fan as claimed in claim 2, wherein, in a center longitudinal axis of said one of the upright crankshafts, the flywheel has a radial carrying region on which a corresponding support region of the fan wheel rests and in which at least one screw connecting the flywheel and the fan wheel is effective.

4. The outboard motor with the fan as claimed in claim 3, wherein the fan wheel is formed by a cylindrical body and has two ring carriers that run at an axial distance relative to each other and are connected with an interconnection of fan wheel blades.

5. The outboard motor with the fan as claimed in claim 4, wherein the fan wheel has, in a region of an axial fastening screw penetrating the carrying and support regions and keeping the flywheel in position on the shaft journal of the one of the upright crankshafts, a dome-like air-directing element for distributing heated airflows.

6. The outboard motor with the fan as claimed in claim 5, wherein the fan wheel and the flywheel are clad with a cylinder-like protective hood having a cover region with an inflow opening and a casing region.

7. The outboard motor with the fan as claimed in claim 6, wherein the conducting device for the heated airflows is integrated into the protective hood, and the protective hood is designed as a fan housing.

8. The outboard motor with the fan as claimed in claim 7, wherein the fan housing has a tangential portion provided at an end region with an outlet device, and the outlet device is connected to the outlet opening in the covering hood.

9. The outboard motor with the fan as claimed in claim 6, wherein the protective hood is provided on an inner side with at least one stiffening rib.

10. The outboard motor with the fan as claimed in claim 4, wherein the fan wheel and the flywheel are clad with a cylinder-like protective hood having a cover region with an inflow opening and a casing region.

11. The outboard motor with the fan as claimed in claim 10, wherein the conducting device for the heated airflows is integrated into the protective hood, and the protective hood is designed as a fan housing.

12. The outboard motor with the fan as claimed in claim 11, wherein the fan housing has a tangential portion provided at an end region with an outlet device, and the outlet device is connected to the outlet opening in the covering hood.

13. The outboard motor with the fan as claimed in claim 10, wherein the protective hood is provided on an inner side with at least one stiffening rib.

14. The outboard motor with the fan as claimed in claim 13, wherein the flywheels, as viewed in a vertical direction, are arranged offset with respect to one another, mutually overlap, and are fastened to the shaft journals, with one of the flywheels and the fan wheel lying above another of the flywheels as viewed in the vertical direction, and the other flywheel is clad with a connecting protective hood supplementing the protective hood and having a cylinder portion.

15. The outboard motor with the fan as claimed in claim 14, wherein the protective hood and the connecting protective hood are produced, as a fan and flywheel covering, from a single piece or are assembled from a plurality of parts.

16. The outboard motor with the fan as claimed in claim 15, wherein the fan and flywheel covering is provided with fastening eyes on outer regions, and the fan and flywheel covering is kept in position by the fastening eyes on the housing of the internal combustion engine by way of holding devices.

17. The outboard motor with the fan as claimed in claim 16, wherein each holding device interacts with the fan and flywheel covering via an elastic support element.

18. The outboard motor with the fan as claimed in claim 10, wherein airflows pass via a first inlet opening in a first upright hood wall into the interior space of the covering hood, the fan is arranged adjacent to a second upright hood wall of the covering hood, said second upright hood wall extends at a distance from the first upright hood wall as viewed in a longitudinal direction of the outboard motor, said fan conveys the airflows over a relatively large region of action, which runs in the longitudinal direction, past the surfaces of the internal combustion engine and the auxiliary units, and the fan conveys the heated airflows as exhaust air with the conducting device into the outlet opening in the covering hood and to the outer side of the covering hood or into the atmosphere.

19. The outboard motor with the fan as claimed in claim 18, wherein the overflow region of another conducting device is located lower in the covering hood than the inflow opening of the protective hood so that the surfaces of the internal combustion engine and the auxiliary units are acted upon in a defined manner from a bottom upward.

* * * * *